US007963078B1

(12) United States Patent
Sorkin

(10) Patent No.: US 7,963,078 B1
(45) Date of Patent: Jun. 21, 2011

(54) COMPRESSION CAP SHEATHING LOCK

(76) Inventor: Felix L. Sorkin, Stafford, TX (US)

( * ) Notice: Subject to any disclaimer, the term of this patent is extended or adjusted under 35 U.S.C. 154(b) by 161 days.

(21) Appl. No.: 12/133,947

(22) Filed: Jun. 5, 2008

Related U.S. Application Data

(63) Continuation-in-part of application No. 12/100,066, filed on Apr. 9, 2008, now abandoned, and a continuation-in-part of application No. 11/950,295, filed on Dec. 4, 2007, now Pat. No. 7,823,345, which is a continuation-in-part of application No. 11/933,041, filed on Oct. 31, 2007, which is a continuation-in-part of application No. 11/933,029, filed on Oct. 31, 2007, now Pat. No. 7,797,895, which is a continuation-in-part of application No. 11/861,185, filed on Sep. 25, 2007, now Pat. No. 7,841,140.

(51) Int. Cl.
*E04C 5/08* (2006.01)

(52) U.S. Cl. ..... 52/223.13; 403/314; 403/367; 403/369; 403/374.1; 24/122.3

(58) Field of Classification Search ..... 52/223.13; 403/367–369, 374.1, 365, 304, 314; 24/122.6, 24/122.3, 459, 136 R, 115 M
See application file for complete search history.

(56) References Cited

U.S. PATENT DOCUMENTS 274,796 A * 3/1883 Loehner ..... 403/314
833,548 A * 10/1906 Putnam ..... 403/368
1,646,660 A * 10/1927 Prince ..... 439/805
2,128,832 A * 8/1938 Lusher ..... 403/303
2,166,458 A * 7/1939 Berndt et al. ..... 439/788
2,699,589 A * 1/1955 Redell ..... 294/102.1
2,834,081 A * 5/1958 Stump, Jr. ..... 403/369
2,930,642 A * 3/1960 Howlett ..... 403/314
3,163,904 A * 1/1965 Ziolkowski ..... 403/365
3,253,332 A * 5/1966 Howlett et al. ..... 29/506
3,534,989 A * 10/1970 Yonkers ..... 403/369
3,573,871 A * 4/1971 Warner ..... 277/607
3,596,330 A * 8/1971 Scott et al. ..... 24/122.3
3,698,749 A * 10/1972 Yonkers ..... 403/197
3,738,591 A * 6/1973 Melluish ..... 242/486.1
3,757,390 A * 9/1973 Edwards ..... 24/115 R
3,877,113 A * 4/1975 Reyes ..... 24/115 M
3,912,406 A * 10/1975 McGrath ..... 403/19
4,146,951 A * 4/1979 Howlett ..... 29/452

(Continued)

OTHER PUBLICATIONS

U.S. Appl. No. 11/861,185, filed Sep. 25, 2007.

(Continued)

*Primary Examiner* — Brian E Glessner
*Assistant Examiner* — Adriana Figueroa
(74) *Attorney, Agent, or Firm* — Egbert Law Offices PLLC

(57) ABSTRACT

A cap for an anchorage of a post-tension anchor system has an outer tubular portion having an inner wall and an outer wall, an inner tubular portion having an inner wall and an outer wall, an end wall extending between the outer tubular portion and the inner tubular portion, and a sheathing lock affixed to the inner wall of the inner tubular portion. The inner wall of the outer tubular portion is in spaced relation to the outer wall of the inner tubular portion. The outer tubular portion and the inner tubular portion are concentric with each other. The sheathing lock has a body having locking ribs extending radially inwardly therefrom. The locking ribs extend in parallel relationship to each other. The outer tubular portion and the inner tubular portion and the end wall are integrally formed of a polymeric material.

13 Claims, 2 Drawing Sheets

U.S. PATENT DOCUMENTS 4,494,890 A * 1/1985 Lusk ..... 403/267
4,619,088 A * 10/1986 Ripoll
Garcia-Mansilla ..... 52/223.13
4,621,842 A * 11/1986 Kowal et al. ..... 285/322
4,623,277 A * 11/1986 Wayne et al. ..... 403/314
4,773,198 A * 9/1988 Reinhardt ..... 52/223.13
4,918,887 A * 4/1990 Davis et al. ..... 52/223.13
5,141,356 A * 8/1992 Chaize ..... 403/368
5,374,135 A * 12/1994 Folsom et al. ..... 403/369
5,469,677 A * 11/1995 Luthi ..... 52/223.13
5,584,513 A * 12/1996 Sweeny et al. ..... 285/323
5,630,301 A * 5/1997 Sieg ..... 52/223.13
5,729,938 A * 3/1998 Tobias ..... 52/220.8
5,770,286 A 6/1998 Sorkin
5,839,235 A 11/1998 Sorkin
5,897,102 A * 4/1999 Sorkin ..... 254/29 A
6,098,356 A 8/2000 Sorkin
6,151,850 A * 11/2000 Sorkin ..... 52/223.13
6,354,596 B1 * 3/2002 Rodriguez ..... 277/317
6,381,912 B1 5/2002 Sorkin
6,513,287 B1 2/2003 Sorkin
6,631,596 B1 10/2003 Sorkin
6,817,148 B1 11/2004 Sorkin
7,458,964 B2 * 12/2008 Mosler et al. ..... 604/540
2003/0159377 A1 * 8/2003 Marshall ..... 52/223.13
2003/0159395 A1 * 8/2003 Dahl ..... 52/726.1
2004/0148881 A1 * 8/2004 Hayes ..... 52/223.13

OTHER PUBLICATIONS

U.S. Appl. No. 11/861,197, filed Sep. 25, 2007.
U.S. Appl. No. 11/874,087, filed Oct. 17, 2007.
U.S. Appl. No. 11/933,041, filed Oct. 31, 2007.
U.S. Appl. No. 11/933,029, filed Oct. 31, 2007.
U.S. Appl. No. 11/950,295, filed Dec. 4, 2007.
U.S. Appl. No. 12/100,066, filed Apr. 9, 2008.

* cited by examiner

COMPRESSION CAP SHEATHING LOCK

CROSS-REFERENCE TO RELATED APPLICATIONS

The present invention is a continuation-in-part of U.S. application Ser. No. 12/100,066, filed on Apr. 9, 2008, entitled "Sheathing Lock", presently pending. U.S. application Ser. No. 12/100,066 is a continuation-in-part of U.S. application Ser. No. 11/950,295, filed on Dec. 4, 2007, entitled "Unitary Sheathing Wedge," presently pending. U.S. application Ser. No. 11/950,295 is a continuation-in-part of U.S. application Ser. No. 11/933,041 filed on Oct. 31, 2007, entitled "Shrinkage Preventing Apparatus for the Sheathing of a Tendon", presently pending, and a continuation-in-part of U.S. application Ser. No. 11/933,029 filed on Oct. 31, 2007, entitled "Shrinkage Preventing Device for the Sheathing of a Tendon", presently pending. U.S. application Ser. No. 11/933,041 is a continuation-in-part of U.S. application Ser. No. 11/861,185 filed on Sep. 25, 2007, entitled "Apparatus for Preventing Shrinkage of a Sheathing Over a Tendon", presently pending. U.S. application Ser. No. 11/933,029 is a continuation-in-part of U.S. application Ser. No. 11/861,185 filed on Sep. 25, 2007, entitled "Apparatus for Preventing Shrinkage of a Sheathing Over a Tendon", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post-tension systems. More particularly, the present invention relates to anchors used in such post-tension systems. More particularly still, the present invention relates to devices used to prevent shrinkage of a sheathing that extends over the tendon within the cavity of an anchor.

2. Description of Related Art Including Information Disclosed Under 37 CFR 1.97 and 37 CFR 1.98.

For many years, the design of concrete structures imitated the typical steel design of column, girder and beam. With technological advances in structural concrete, however, concrete design began to evolve. Concrete has the advantages of costing less than steel, of not requiring fireproofing, and of having plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete maybe constructed with load-bearing walls, but this method does not use the full potentialities of the concrete. The skeleton frame, in which the floors and roofs rest directly on exterior and interior reinforced-concrete columns, has proven to be most economical and popular. Reinforced-concrete framing is seemingly a simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, comprising a mixture of water, cement, sand, and stone or aggregate and having proportions calculated to produce the required strength, is set, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing tendons of high tensile-strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual concrete members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges or threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live-end" anchor, and the opposite end is known as the "dead-end" anchor. The "live-end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

One technique for forming such dead-end anchors is to insert the end of a tendon into the cavity of the anchor, inserting wedges into the space between the tendon and the wall of the cavity and then applying a tension force onto another end of the tendon so as to draw the wedges and the end of the tendon into the cavity in interference-fit relationship therewith. This procedure is somewhat difficult because the tendon can have a considerable length and because the use of tension forces can create a somewhat unreliable connection between the wedges and the tendon. Experimentation has found that the application of compressive force onto the end of the tendon creates a better interference-fit relationship between the wedges, the end of the tendon and the wall of the cavity of the anchor.

Another technique is described in U.S. Pat. No. 6,513,287, issued on Feb. 4, 2003 to the present inventor. This patent describes a method and apparatus for forming an anchorage of a post-tension system in which a tendon is positioned within a cavity of the anchor such that an end of the tendon extends outwardly of the cavity. A plurality of wedges are mechanically inserted within the cavity between the tendon and a wall of the cavity. Pressure is applied to an end of the tendon such that the tendon and the wedges are in interference-fit relationship within the cavity. A compression mechanism has a cylindrical member and a plunger extending in a channel of the cylindrical member. The wedges are attached to the cylindrical member and the cylindrical member is moved toward the cavity such that the wedges enter a space between the tendon and the wall of the cavity. The plunger applies a compressive force to the end of the tendon when the end of the tendon is in the channel of the cylindrical member.

One of the problems with conventional dead-end anchorages is that the sheathing over the tendon has a tendency to shrink over time. The shrinkage is the result of various factors. One major factor is that the sheathing is formed over the tendon in an extrusion process. As such, the polymeric material used for the sheathing is relatively hot as it exits the extrusion process. Immediately after leaving the extrusion process, the tendon, along with the sheathing, are tightly wound around a spool. During shipment, the tight winding of the tendon around the spool will mechanically resist any shrinking of the sheathing over the lubricated exterior of the steel cable on the interior of the sheathing. When the cable is unwound from the spool, these mechanical forces are released. As such, as the tendon is installed in an anchor, the relaxation of these mechanical forces will generally and slowly cause the sheathing to shrink over the length of the tendon. After the tendon is connected to a dead-end anchorage, the end of the sheathing will tend to shrink slowly away from the dead-end anchorage.

The problem that affects many anchorage systems is the inability to effectively prevent liquid intrusion into this area of the unsheathed portion where sheathing shrinkage has occurred. In normal practice, a liquid-tight tubular member is placed onto an end of the tendon so as to cover an unsheathed portion of the tendon. The tubular member slides onto and over the trumpet portion of the encapsulated anchor so as to be frictionally engaged with the trumpet portion of the anchor. The opposite end of the tubular member will include a seal that establishes a generally liquid-tight connection with the sheathed portion of the tendon.

In the past, various patents have issued to the present inventor relating to such corrosion-protection tubes. These patents were developed for the purpose of accommodating the natural shrinkage of the sheathing over the lubricated cable. For example, U.S. Pat. No. 5,839,235, issued on Nov. 20, 1998 to the present inventor, describes a corrosion protection tube for a post-tension anchor system. A tubular body is affixed in snap-fit engagement with the trumpet portion so as to extend outwardly from the trumpet portion in axial alignment therewith. The tubular body has a seal at an end opposite the trumpet portion so as to form a generally liquid-tight seal with an exterior surface of the tendon. The tubular body has a notch formed on an exterior surface thereof. The trumpet portion has an inwardly extending surface. The inwardly extending surface engages the notch so as to form a generally liquid-tight connection. A collar extends around the tubular body on a side of the notch so as to be in close relationship to the end of the trumpet portion.

U.S. Pat. No. 6,631,596, issued on Oct. 14, 2003 to the present inventor, teaches another corrosion protection tube for use on an anchor of a post-tension anchor system. This corrosion protection tube has a connection portion at one end and a sealing portion on an opposite end. The anchor has a trumpet portion with a notch extending therearound. The connection portion includes an inwardly extending surface for engagement with the notch of the trumpet portion. The sealing portion is in liquid-tight engagement with the sheathed portion of the tendon. Alternatively, the connection portion includes an additional inner sleeve so as to define an annular slot with the inwardly extending surface. The inner sleeve extends into the interior of the trumpet portion so that the inner sleeve and the trumpet portion are in a liquid-tight engagement.

U.S. Pat. No. 6,817,148, issued on Nov. 16, 2004 to the present inventor, describes another type of corrosion protection seal for the anchor of a post-tension anchor system. A seal member is affixed to an end of the tubular portion of the anchor opposite the anchor body. The seal member has a portion extending around the sheathed portion of the tendon in generally liquid-tight relationship therewith. The tubular portion has an interlock area extending therearound for engaging an interior surface of the seal member. The tubular portion has a length of generally greater than four inches extending outwardly of the anchor body.

U.S. Pat. No. 5,770,286, issued on Jun. 23, 1998 to the present inventor, shows a corrosion inhibitor retaining seal. This seal includes a cap having a tubular body and a surface extending across the of the tubular body. A corrosion-resistant material is contained within the interior area of the cap. This surface closes the end of the tubular body. A frangible area is formed on this surface The surface extends transverse to a longitudinal axis of the tubular body at one end of the tubular body. The frangible area has a thickness less than a thickness of a non-frangible remainder of the surface. The cap is formed of a polymeric material. The surface is formed of a deformable polymeric material such that the non-frangible portion of the surface forms a liquid-tight seal with an outer diameter of a tendon extending through the surface. The corrosion-resistant material is contained within the cap of a suitable volume so as to fill a void in the tubular member between the inner diameter of the tubular member and the outer diameter of a tendon extending therethrough.

U.S. Pat. No. 6,098,356, issued on Aug. 8, 2000 to the present inventor, shows a method and apparatus for sealing an intermediate anchorage of a post-tension system. This apparatus has a cap with an attachment section thereon. The attachment section is adapted to allow the cap to be connected to an end of the anchor body. The cap has a tubular member extending outwardly from the attachment section. The tubular member has an opening at an end opposite the attachment section. The cap also has a grease fitting formed thereon. The grease fitting is adapted so as to allow grease to be introduced into the interior passageway of the tubular member. The attachment section and the tubular member are integrally formed together of a polymeric material. A seal is affixed to the open end of the tubular member so as to form a liquid-tight seal over the sheathed portion of a tendon extending therethrough.

U.S. Pat. No. 6,381,912, issued on May 7, 2002 to the present inventor also shows a method of sealing the intermediate anchor of a post-tension system. An elastomeric seal has one end affixed to the anchor member and extending outwardly therefrom. A rigid ring member is detachably received within an opposite end of the seal. The ring member has an inner diameter greater than an outer diameter of the tendon. The opposite end of the seal is in liquid-tight compressive contact with the exterior surface of the tendon when the ring member is detached from the seal. The interior passageway of the anchor, the seal and the ring member have an inner diameter, when joined together, which is larger than the outer diameter of the tendon so as to allow the anchor member, the seal and the ring member to slide along the length of the tendon.

As can be seen, there is a great deal of technology associated with this need to accommodate the shrinkage of the sheathing over the cable of the tendon of the post-tension anchor system. Each of this technology suggests the placement of an additional tube over the polymeric encapsulation and additional materials for sealing the unsheathed portion of the tendon which extends outwardly of the anchor. In certain circumstances, these tubes are sometimes improperly installed and, at best, are simply an additional component that needs to be associated with the post-tension system. As such, it adds additional costs and can require additional labor associated with the installation of the sealing tube. As such, a need has developed so as to prevent the shrinkage of the sheathing of a tendon so as to avoid the use of such a tube with the anchors of a post-tension anchor system.

Various patents have been filed by the present inventor addressing the need to prevent the shrinkage of the sheathing of a tendon. For example, U.S. application Ser. No. 11/861,185 filed on Sep. 25, 2007, discloses an apparatus for fixing the sheathing of an end of a tendon within an anchor body of a post-tension anchor system that has an anchor body with a cavity formed therein, a tendon extending into the cavity, a fixing element engaged with the sheathing of the tendon for fixing a position of the sheathing on the tendon, and a pair of wedges in frictional engagement with the unsheathed portion of the tendon within the anchor body. The fixing element is positioned within the cavity. The fixing element can either be a wedge member interposed between the sheathing and the tendon so as to frictionally engage the tendon or a clip member engaged with the sheathing.

U.S. patent application Ser. No. 11/861,197, filed on Sep. 25, 2007, discloses a sheathing-retaining article for use with a post-tension anchorage system that has a wedge with a tendon-retaining portion and a sheathing-retaining portion. The tendon-retaining portion has a channel extending longitudinally therealong. The channel is suitable for retaining the tendon therein. The tendon-retaining portion has a tapering outer surface with a wide end at one end of the wedge and a narrow end spaced therefrom. The sheathing-retaining portion extends outwardly from the narrow end of the tendon-retaining portion. The sheathing-retaining portion engages a sheathing of a tendon extending through the channel of the wedge.

U.S. patent application Ser. No. 11/874,087, filed on Oct. 17, 2007, discloses an apparatus for preventing shrinkage of a sheathing of a tendon that has an anchor body having a cavity formed in an interior thereof, a tendon extending into the cavity, a fixing element engaged with the sheathing for fixing a position of the sheathing on the tendon, and a pair of wedges in frictional engagement with the unsheathed portion of the tendon in the cavity of the anchor body. The fixing element is positioned away from the cavity of the anchor. An encapsulation is formed over the anchor body so as to define a trumpet extending outwardly from one side of the anchor body. A clamp is engaged with the sheathed portion of the tendon within the trumpet.

U.S. patent application Ser. No. 11/933,041, filed on Oct. 31, 2007, discloses an apparatus for fixing the sheathing of an end of a tendon within an anchor body of a post-tension anchor system that has an anchor body with a cavity formed in an interior thereof, a tendon extending into the cavity that has a sheathing extending at least partially thereover and has a sheathed portion and an unsheathed portion, a pair of wedges in frictional engagement with the unsheathed portion of the tendon in the cavity of the anchor body, and at least one wedge member engaged with the sheathed portion. The wedge member has a first portion and a second portion. The first portion is of a constant thickness and has an end adjacent the pair of wedges. The second portion has a first end and a second end, the second portion being of a decreasing thickness from the first end to the second end.

U.S. patent application Ser. No. 11/933,029, filed on Oct. 31, 2007, discloses a device for fixing the sheathing of an end of a tendon within an anchor body of a post-tension anchor system that has an anchor body having a cavity formed in an interior thereof, a tendon extending into the cavity having a sheathing extending at least partially thereover and having a sheathed portion and an unsheathed portion, a pair of wedges in frictional engagement with the unsheathed portion of the tendon in the cavity of the anchor body, and at least one wedge member engaged with the sheathed portion. The wedge member has a wide end and a narrow end, the wide end being adjacent to the pair of wedges. The wedge member has a decreasing thickness from the wide end to the narrow end.

U.S. patent application Ser. No. 11/950,295, filed on Dec. 4, 2007, discloses an apparatus for fixing the sheathing of an end of a tendon within an anchor body of a post-tension anchor system that has an anchor body having a cavity formed in an interior thereof, a tendon extending into the cavity and having a sheathing extending at least partially thereover and having a sheathed portion and an unsheathed portion, a pair of wedges engaged with the unsheathed portion of the tendon in the cavity of the anchor body, and a wedge member engaged with the sheathing of the sheathed portion. The wedge member is a unitary piece having a longitudinal split extending from an end of the piece to an opposite end of the piece. The wedge member substantially encircles an interior or an exterior of the sheathing of the sheathed portion of the tendon.

U.S. patent application Ser. No. 12/100,066, filed on Apr. 9, 2008, discloses a sheathing lock that has a tubular body having an inner surface and an outer surface and a first end and a second end, a collar formed at the second end, a locking thread extending radially inwardly from the inner surface, and a longitudinal split extending from the first end to the second end. The collar has an inside and an outside. The outside has a diameter equal to a diameter of the outer surface. The inside has a diameter less than a diameter of the inner surface. The collar has a gap aligned with the longitudinal split of the tubular body. The gap is wider than the longitudinal split. The longitudinal split tapers from the second end to the first end. The locking thread extends radially inwardly so as to have an inner diameter greater than the inner diameter of the collar. The locking thread has a trapezoid cross-sectional shape.

In using the various above-identified sheathing retaining devices, it has been found that the curvature of the sheathing surrounding a tendon is inconsistent. This inconsistent curvature creates a problem for the substantially circular tubular bodies of the sheathing retaining devices because the inconsistent portions of the sheathing are not adequately held by the substantially circular devices. Thus, there is now a need for a sheathing retaining device that retains the sheathing of a tendon while accommodating for inconsistencies in the curvature of the sheathing around the tendon.

Additionally, it has been found by using the above-identified sheathing retaining devices that using sheathing locks within the cavity of an anchor body is sometimes not necessary and difficult to accomplish. Some anchors in post-tension systems are formed with encapsulations having trumpets extending from an end thereof, which make access to the cavity of the anchor body more difficult than anchors without such trumpets. Thus, there is a need for a sheathing retaining device that prevents sheathing shrinkage while accommodating for the trumpet that extends away from the cavity of the anchor body.

It is an object of the present invention to provide sheathing-retaining device which effectively prevents shrinkage of the sheathing at an anchor of a post-tension anchor system.

It is another object of the present invention to provide a sheathing-retaining device that accommodates anchors having trumpets extending from an end thereof.

It is another object of the present invention to provide a sheathing-retaining device that can be easily installed during the installation of the wedges associated with the anchorages of a post-tension anchor system.

It is another object of the present invention to provide a sheathing-retaining device which effectively engages the sheathing of a tendon at the anchor so as to resist shrinkage forces associated with the sheathing.

It is still another object of the present invention to provide a sheathing-retaining device which resists the shrinkage of the sheathing of a tendon of a post-tension anchor system which is easy to install, relatively inexpensive and easy to manufacture.

These and other objects and advantages of the present invention will become apparent from a reading of the attached specification and appended claims.

BRIEF SUMMARY OF THE INVENTION

The present invention is a cap for an anchorage of a post-tension anchor system comprising an outer tubular portion having an inner wall and an outer wall, an inner tubular portion having an inner wall and an outer wall, an end wall extending between the outer tubular portion and the inner tubular portion, and a sheathing lock affixed to the inner wall of the inner tubular portion. The inner wall of the outer tubular portion is in spaced relation to the outer wall of the inner tubular portion. The outer tubular portion and the inner tubular portion are concentric with each other. The sheathing lock has a body having a plurality of locking ribs extending radially inwardly therefrom. The plurality of locking ribs extend in parallel relationship to each other. The outer tubular portion and the inner tubular portion and the end wall are integrally formed of a polymeric material.

The cap is used in an anchorage assembly for a post-tension anchor system. The anchorage assembly has an anchor body and an encapsulation affixed around the anchor body. The encapsulation has a trumpet extending outwardly from one end of the anchor body. The cap is attachable to the trumpet. The trumpet extends between the inner wall of the outer tubular portion and the outer wall of the inner tubular portion. The trumpet has an end abutting the end wall. A tendon is affixed to the anchor body and extends through the trumpet. The tendon has an unsheathed portion and a sheathed portion. The sheathing lock engages the sheathed portion so as to fix the sheathed portion within the trumpet. The anchor body has a cavity formed in an interior thereof. The cavity has a tapered portion and a generally constant diameter portion. The sheathed portion extends into the generally constant diameter portion. A pair of wedges is affixed within the tapered portion of the cavity so as to engage with the unsheathed portion of the tendon. The cap is in generally liquid-tight sealing relation with the sheathed portion of the tendon.

The anchorage assembly is used in a post-tension anchor system with a tendon having a sheathed portion and an unsheathed portion. The anchor body is affixed to the unsheathed portion of the tendon. The trumpet extends around the sheathed portion of the tendon. The sheathing lock is connected to the cap. The sheathing lock is engaged with the sheathed portion of the tendon so as to fix a position of the sheathed portion. The plurality of locking ribs are engaged with the sheathed portion. The anchor body has a cavity formed in an interior thereof. The cavity has a tapered portion and a generally constant diameter portion. The sheathed portion has an end received in the generally constant diameter portion. A pair of wedges are received in the tapered portion and are engaged with the unsheathed portion of the tendon.

DETAILED DESCRIPTION OF THE INVENTION

Figure 1:
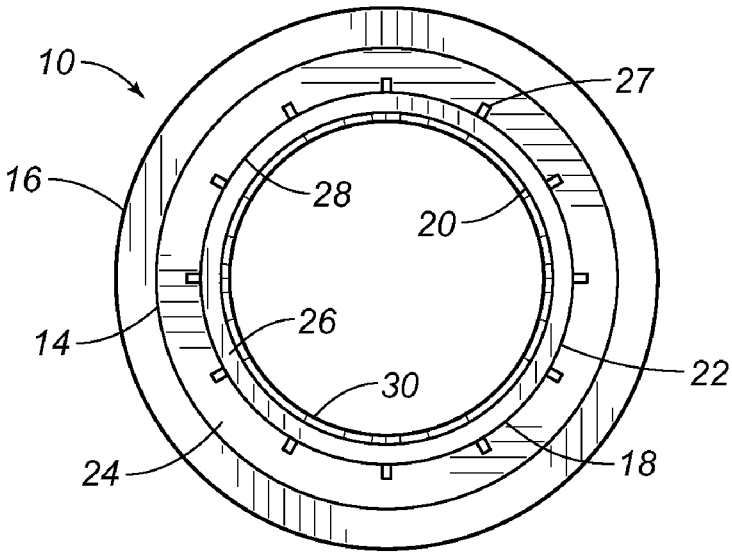
FIG. 1 shows a bottom elevational view of the preferred embodiment of the cap of the present invention.

Referring to FIG. 1, there is shown a bottom elevational view of the preferred embodiment of the cap 10 of the present invention. The cap 10 has an outer tubular portion 12 and an inner tubular portion 18. The outer tubular portion 12 has an inner wall 14 and an outer wall 16. The inner tubular portion 18 has an inner wall 20 and an outer wall 22. An end wall 24 extends between the outer tubular portion 12 and the inner tubular portion 18. More particularly, the end wall 24 extends between the inner wall 14 of the outer tubular portion 12 and the outer wall 22 of the inner tubular portion 18. The inner wall 14 of the outer tubular portion 12 is in spaced relation to the outer wall 22 of the inner tubular portion 18. The outer tubular portion 12 and the inner tubular portion 18 are concentric with each other. The outer tubular portion 12 and the inner tubular portion 18 and the end wall 24 are integrally formed of a polymeric material.

A sheathing lock 26 is affixed to the inner wall 20 of the inner tubular portion 18. The sheathing lock 26 has a body 28. Locking ribs 30 extend radially inwardly from the body 28 of the sheathing lock 26. Fins 27 extend radially outwardly from the body 28 of the sheathing lock 26. The fins 27 are equally spaced along the perimeter of the body 28.

Figure 2:
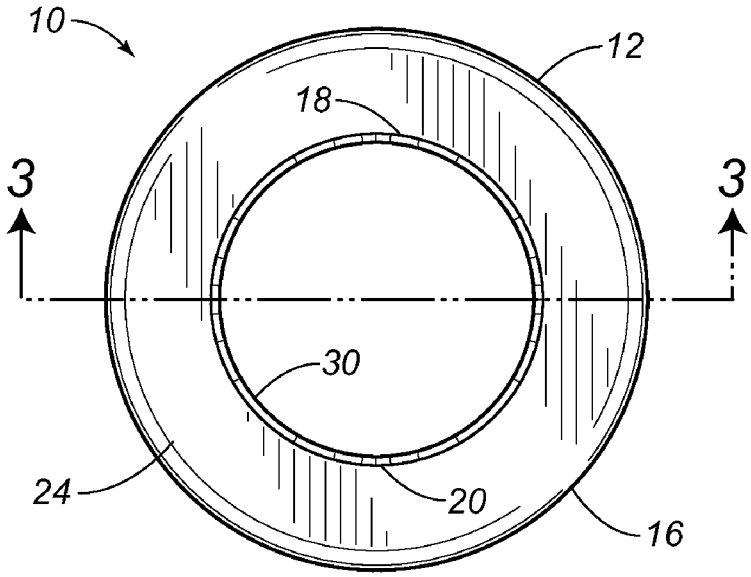
FIG. 2 shows a top elevational view of the first embodiment of the cap of the present invention.

Referring to FIG. 2, there is shown a top elevational view of the preferred embodiment of the cap 10 of the present invention. The end wall 24 extends over the outer tubular portion 12 and the inner tubular portion 18. The outer diameter of the end wall 24 is the same as the outer wall 16 of the outer tubular portion 12. The inner diameter of the end wall 24 is the same as the inner wall 20 of the inner tubular portion 18. The locking ribs 30 extend radially inwardly so as to have an inner diameter smaller than the inner diameter of the inner wall 20 of the inner tubular portion 18.

Figure 3:
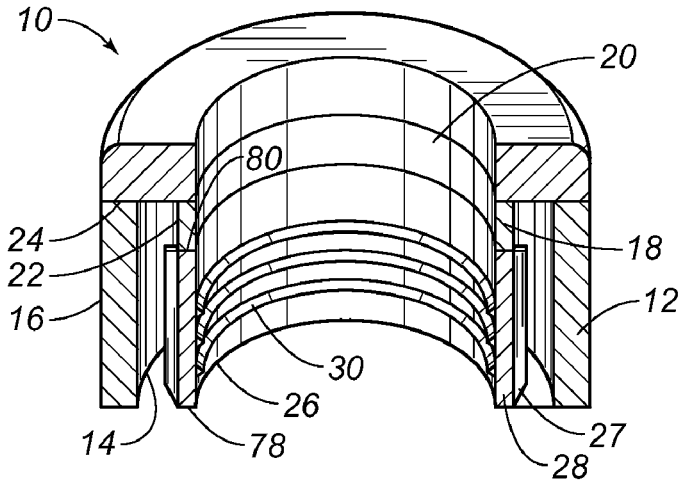
FIG. 3 shows a perspective cross-sectional view of the cap of the present invention taken along site line 3-3 of FIG. 1.

Referring to FIG. 3, there is shown a cross-sectional perspective view of the cap 10 of the present invention taken along sight line 3-3 of FIG. 2. The inner wall 20 of the inner tubular portion 18 and the body 28 of the sheathing lock 26 have the same diameters. The locking ribs 30 can be seen as extending radially inwardly from the body 28. The locking ribs 30 are parallel to one another. The locking ribs 30 are equally spaced from one another. The fins 27 can be seen as extending radially outwardly from the body 28 of the sheathing lock 26. The fins 28 taper in height from the first end 80 to the second end 78 of the body 28 of the sheathing lock 26.

The inner tubular portion 18 is shorter than the outer tubular portion 12. The length of the inner tubular portion 18 added to the length of the sheathing lock 26 is approximately equal to the length of the outer tubular portion 12. The outer tubular portion 12 is thicker than the inner tubular portion 18.

Figure 4:
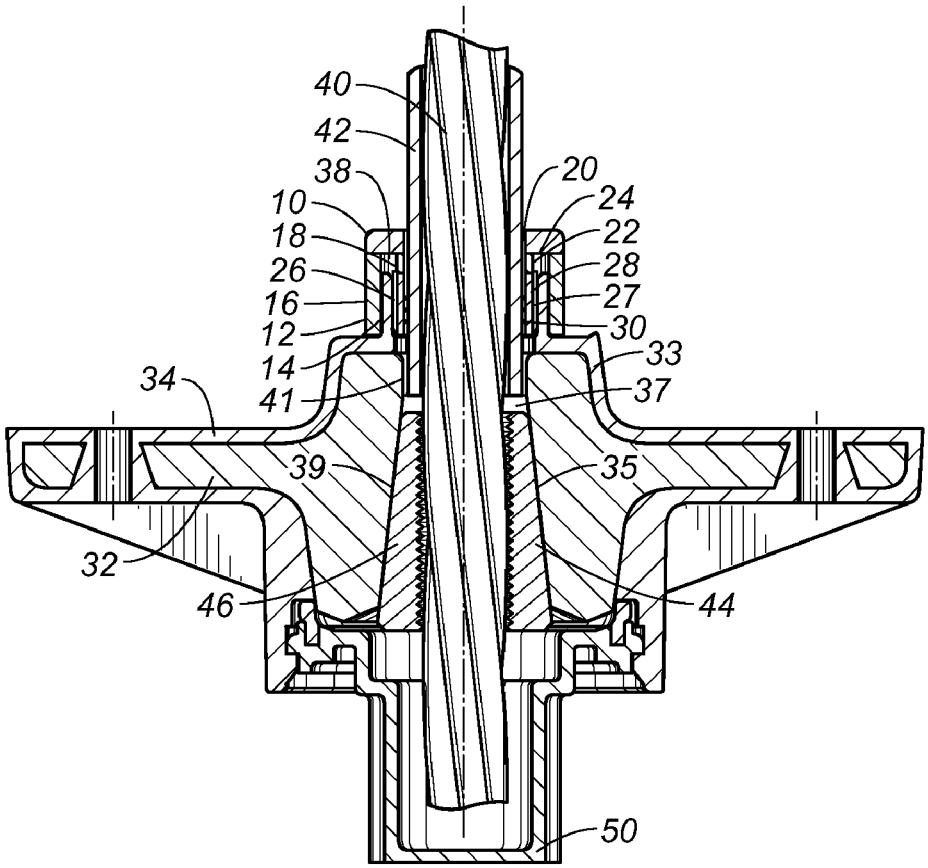
FIG. 4 shows a cross-sectional view of the first embodiment of the post-tension anchor system of the present invention, including the anchorage assembly of the present invention.

Referring to FIG. 4, there is shown a cross-sectional view of the cap 10 of the present invention, as used with a tendon 40 and anchor 34. An anchor body 32 has an encapsulation 34 affixed therearound. The encapsulation 34 has a trumpet 36 that extends outwardly from end 33 of the anchor body 32. The cap 10 is attached to the trumpet 36. A tendon 40 extends through the trumpet 36 and through the anchor body 32 and encapsulation 34. A sheathing extends around the tendon 40 to form the sheathed portion 42. The unsheathed portion 44 of the tendon 40 extends through the anchor body 32 and is held in the anchor body 32 by wedges 46. The interior 37 of the anchor body 32 has a cavity 35. The cavity 35 of the anchor body 32 has a tapered portion 39 and a generally constant diameter portion 41. The sheathed portion 42 of the tendon 40 extends into the trumpet 36 of the encapsulation 34 and into the generally constant diameter portion 41 of the cavity 35 of the anchor body 32. The wedges are affixed within the tapered portion 39 of the cavity 35 so as to engage the unsheathed portion 44 of the tendon 40. The trumpet 36 extends between the inner wall 14 of the outer tubular portion 12 and the outer wall 22 of the inner tubular portion 18. The end 38 of the trumpet 36 abuts the end wall 24 of the cap 10. In FIG. 4, the sheathing lock 26 is positioned between the inner wall 14 of the outer tubular portion 12 and the outer wall 22 of the inner tubular portion 18. The sheathing lock 26 engages the sheathed portion 42 of the tendon 40 so as to fix the sheathed portion 42 within the trumpet 26. It is possible that the sheathing lock 26 extends into the generally constant diameter portion 41 of the cavity 35 in other embodiments of the cap 10 so as to fix the sheathed portion 42 of the tendon 40.

Referring still to FIG. 4, the cap 10 of the present invention is used on an end anchor. That is, the type of anchor shown in FIG. 4 is a live-end or dead-end anchor. The anchor is a live-end or dead-end anchor because an end cap 50 seals the end of the tendon 40 that extends out of the anchor as an unsheathed portion 44. The cap 10 of the present invention can also be used on an intermediate anchor in a post-tension anchor system so as to prevent the shrinkage of the sheathing of the tendon 40 proximate an intermediate anchor.

The foregoing disclosure and description of the invention is illustrative and explanatory thereof. Various changes in the details of the illustrated construction can be made within the scope of the appended claims without departing from the true spirit of the invention. The present invention should be limited only by the following claims and their legal equivalents.

I claim:

1. A cap for retaining a sheath of a tendon and used with an anchorage of a post-tension anchor system, the cap comprising:

an outer tubular portion having an inner wall and an outer wall;

an inner tubular portion having an inner wall and an outer wall;

an end wall extending between said outer tubular portion and said inner tubular portion, said outer tubular portion being spaced from said inner tubular portion so as to define a circumferential slot free of obstructions opening at an end of said outer and inner tubular portions opposite said end wall, said circumferential slot extending around an exterior of said outer wall of said inner tubular portion and an interior of said outer tubular portion; and a sheathing lock affixed to said inner wall of said inner tubular portion, said sheathing lock comprising a body having a plurality of locking ribs extending radially inwardly therefrom each of said plurality of locking ribs having a sharp edge opposite said inner wall of said inner tubular portion, so as to bite into the sheathing, each of said plurality of locking ribs extending circumferentially around at least a portion of said inner wall of said inner tubular portion, said plurality of locking ribs being spaced longitudinally from each other along said inner wall of said inner tubular portion.

2. The cap of claim 1, said outer tubular portion and said inner tubular portion being concentric with each other.

3. The cap of claim 1, said outer tubular portion and said inner tubular portion and said end wall being integrally formed of a polymeric material.

4. An anchorage assembly for a post-tension anchor system comprising:

an anchor body;

an encapsulation affixed around said anchor body, said encapsulation having a trumpet extending outwardly from one end of said anchor body; and a cap attached to said trumpet, said cap comprising:

an outer tubular portion having an inner wall and an outer wall;

an inner tubular portion having an inner wall and an outer wall;

an end wall extending between said outer tubular portion and said inner tubular portion;

a sheathing lock affixed to said inner wall of said inner tubular portion such that said sheathing lock resides within an interior of said trumpet, said sheathing lock being a body having a plurality of locking ribs extending radially inwardly therefrom, each of said plurality of locking ribs having a sharp edge opposite said inner wall; and a tendon affixed to said anchor body and extending through said trumpet, said tendon having an unsheathed portion and a sheathed portion, said sharp edge of said plurality of locking ribs of said sheathing lock biting into said sheathed portion so as to fix said sheathed portion directly with an interior of said trumpet.

5. The anchorage assembly of claim 4, said trumpet extending between said inner wall of said outer tubular portion and said outer wall of said inner tubular portion.

6. The anchorage assembly of claim 5, said trumpet having an end abutting said end wall.

7. The anchorage assembly of claim 4, said anchor body having a cavity formed in an interior thereof, said cavity having a tapered portion and a generally constant diameter portion, said sheathed portion extending into said generally constant diameter portion.

8. The anchorage assembly of claim 7, further comprising:

a pair of wedges affixed within said tapered portion of said cavity so as to engage with said unsheathed portion of said tendon.

9. The anchorage assembly of claim 4, said cap being in generally liquid-tight sealing relation with said sheathed portion of said tendon.

10. A post-tension anchor system comprising:

a tendon having a sheathed portion and an unsheathed portion;

an anchor body affixed to said unsheathed portion of said tendon;

an encapsulation affixed around said anchor body, said encapsulation defining a trumpet extending outwardly of an end of said anchor body, said trumpet extending around said sheathed portion of said tendon;

a cap affixed to said trumpet of said encapsulation, said cap being in generally liquid-tight sealing relationship with said sheathed portion of said tendon; and a sheathing lock connected to said cap, said sheathing lock engaged with said sheathed portion of said tendon so as to fix a position of said sheathed portion, said sheathing lock having a plurality of locking ribs extending radially inwardly therefrom, said plurality of locking ribs biting into said sheathed portion directly within an interior of said trumpet, each of said plurality of locking ribs extending entirely around an interior of said sheathing lock, each of said plurality of locking ribs being longitudinally spaced from an adjacent locking rib of said plurality of locking ribs.

11. The system of claim 10, said cap comprising:

an outer tubular portion having an inner wall and an outer wall;

an inner tubular portion having an inner wall and an outer wall; and an end wall extending between said outer tubular portion and said inner tubular portion, said sheathing lock affixed to said inner tubular portion.

12. The system of claim 11, said trumpet being interposed between said outer tubular portion and said inner tubular portion, said trumpet having an end adjacent said end wall of said cap.

13. The system of claim 10, said anchor body having a cavity formed in an interior thereof, said cavity having a tapered portion and a generally constant diameter portion, said sheathed portion having an end received in said generally constant diameter portion, the system further comprising:

a pair of wedges received in said tapered portion and engaged with said unsheathed portion of said tendon.

* * * * *